US007758158B2

(12) United States Patent
Ohkuma et al.

(10) Patent No.: US 7,758,158 B2
(45) Date of Patent: Jul. 20, 2010

(54) INK JET HEAD AND ITS MANUFACTURE METHOD

(75) Inventors: Norio Ohkuma, Tokyo (JP); Akihiko Shimomura, Kanagawa (JP); Etsuko Hino, Kanagawa (JP); Hikaru Ueda, Kanagawa (JP); Helmut Schmidt, Saarbrücken (DE); Peter Muller, Lingen (DE); Steffen Pilotek, Saarbrücken (DE); Carsten Becker-Willinger, Saarbrücken (DE); Pamela Kalmes, Quierschied (DE)

(73) Assignee: Canon Kabushiki Kaisha, Tokyo (JP)

( * ) Notice: Subject to any disclaimer, the term of this patent is extended or adjusted under 35 U.S.C. 154(b) by 730 days.

(21) Appl. No.: 10/557,028

(22) PCT Filed: Jul. 22, 2003

(86) PCT No.: PCT/JP03/09245

§ 371 (c)(1),
(2), (4) Date: Nov. 16, 2005

(87) PCT Pub. No.: WO2005/007413

PCT Pub. Date: Jan. 27, 2005

(65) Prior Publication Data

US 2007/0085877 A1 Apr. 19, 2007

(51) Int. Cl.
*B41J 2/135* (2006.01)

(52) U.S. Cl. ..... 347/45; 524/381; 525/103

(58) Field of Classification Search ..... 347/45; 428/64.4

See application file for complete search history.

(56) References Cited

U.S. PATENT DOCUMENTS

| | | | | |
|---|---|---|---|---|
| 5,010,356 | A * | 4/1991 | Albinson | 347/45 |
| 5,136,310 | A * | 8/1992 | Drews | 347/45 |
| 5,335,004 | A * | 8/1994 | Matsuhisa | 347/65 |
| 5,387,646 | A * | 2/1995 | Nakahata et al. | 525/103 |
| 5,644,014 | A | 7/1997 | Schmidt et al. | |
| 5,730,889 | A | 3/1998 | Miyagawa et al. | |
| 5,786,832 | A | 7/1998 | Yamanaka et al. | |
| 5,910,372 | A | 6/1999 | Griffin et al. | |
| 6,113,222 | A | 9/2000 | Ohkuma | |
| 6,139,761 | A | 10/2000 | Ohkuma | |
| 6,228,921 | B1 * | 5/2001 | Kasemann et al. | 524/381 |

(Continued)

FOREIGN PATENT DOCUMENTS

EP 0 539 947 A 5/1993

(Continued)

OTHER PUBLICATIONS

English-language translation of Korean Official Letter/Search Report dated Dec. 7, 2006 issued in corresponding foreign patent application.

(Continued)

*Primary Examiner*—Stephen D Meier
*Assistant Examiner*—Alexander C Witkowski
(74) *Attorney, Agent, or Firm*—Fitzpatrick, Cella, Harper & Scinto

(57) ABSTRACT

An ink jet head is formed with a nozzle surface having a liquid repellent characteristic. The nozzle surface comprises a condensation product made from a hydrolyzable silane compound having a fluorine containing group and a hydrolyzable silane compound having a cationic polymerizable group.

17 Claims, 5 Drawing Sheets

U.S. PATENT DOCUMENTS

| | | | | |
|---|---|---|---|---|
| 6,231,984 | B1 * | 5/2001 | Horibe et al. | 428/416 |
| 6,283,578 | B1 | 9/2001 | Popall et al. | |
| 6,305,080 | B1 | 10/2001 | Komuro et al. | |
| 6,455,112 | B1 | 9/2002 | Ohkuma et al. | |
| 6,766,579 | B2 | 7/2004 | Ohkuma | |
| 7,226,651 | B2 * | 6/2007 | Hayashida et al. | 428/64.4 |
| 2002/0001016 | A1 | 1/2002 | Aono et al. | |
| 2002/0196311 | A1 | 12/2002 | Shimomura et al. | |
| 2003/0081063 | A1 | 5/2003 | Stanton et al. | |
| 2006/0132539 | A1 | 6/2006 | Hino et al. | |
| 2006/0153993 | A1 | 7/2006 | Schmidt et al. | |
| 2006/0154091 | A1 | 7/2006 | Schmidt et al. | |

FOREIGN PATENT DOCUMENTS

| | | |
|---|---|---|
| EP | 0 587 667 | 9/1995 |
| EP | 0 816 094 | 1/1998 |
| EP | 0 942 024 A | 9/1999 |
| EP | 0 778 869 | 1/2001 |
| JP | 4-10940 | 1/1992 |
| JP | 4-10941 | 1/1992 |
| JP | 4-10942 | 1/1992 |
| JP | 6-171094 | 6/1994 |
| JP | 6-210857 | 8/1994 |
| JP | 6-210859 | 8/1994 |
| JP | 6-286149 | 10/1994 |
| JP | 10-505870 | 6/1998 |
| JP | 11-322896 | 11/1999 |
| JP | 11-335440 | 12/1999 |
| JP | 2000-117902 | 4/2000 |
| JP | 2000-322896 | 11/2000 |
| JP | 3306442 | 5/2002 |
| JP | 2003-129039 | 5/2003 |
| KR | 2006-0037387 | 5/2006 |

OTHER PUBLICATIONS

Chinese Office Action dated May 18, 2007, issued in corresponding Chinese patent application No. 03826488.9, with English-language translation.

Office Action in Korean Application No. 2007-052036593, dated Sep. 27, 2007.

Patent Abstracts of Japan, vol. 2000, No. 07, Sep. 29, 2000 (JP 2000-117902, Apr. 25, 2000).

Nakagawa et al., "Water-Repellent Thin Film with High Alkali Resistance Using the Sol-Gel Method for Ink Jet Printer Head," Japanese Journal of Applied Physics, vol. 41, Jun. 2002, pp. 3896-3901.

Full English translation of JP 2000-117902.

* cited by examiner

INK JET HEAD AND ITS MANUFACTURE METHOD

TECHNICAL FIELD

This invention is liquid repellent processing on the surface of a nozzle in an ink jet head.

BACKGROUND ART

Recently, technical development as to the improvement in performance of smaller droplets, higher drive frequency and increased numbers of nozzles is continued in order to make the recording characteristics more advanced in an ink jet recording system. And image recording is performed by ejecting liquid from an ejection opening as small droplets which adhere to the recording medium typified by paper.

Here, a surface treatment is becoming more important to maintain ejecting performance by keeping ejecting opening surface as the same condition at any time.

Moreover, it is common to wipe off the ink which remained on the surface by e.g. rubber blades periodically to maintain the condition of the ejecting opening surface in an ink jet head. A liquid repellent material is demanded for easy wiping, and wiping durability.

Since the ink used for an ink jet head is not neutral in many cases, it is also required that the liquid repellent material should have durability against ink and have adhesion power to a nozzle.

Furthermore, since precise nozzle structure is required for a nozzle in order to obtain a high-quality image in recent years, it is also required that the liquid repellent material should have photo-sensitive characteristic of corresponding to patterning by photo-lithography.

This invention applies the hydrolyzable silane compound that has fluorine containing group to the liquid repellent processing on the surface of a nozzle.

The following official report is raised as a conventional example using the hydrolyzable silane compound that has a fluorine containing group.

Japanese patent Application Laid-Open No. H06-171094 and No. H06-210857 are indicating the method of performing the so-called silane coupling processing to the nozzle surface which formed the oxide particle layer beforehand using the hydrolyzable silane compound which has a fluorine containing group.

However, sufficient wiping durability is not acquired by the above-mentioned method. Furthermore, it is difficult to give the photo-sensitive characteristic to liquid repellent material by the above-mentioned system.

U.S. Pat. No. 5,910,372, EP B1 778869 and Japanese patent publication No. H10-505870 are indicating the possibility of the application to the coating and the ink jet nozzle which consists of a condensed composition which comprises a hydrolyzable silane compound having a fluorine containing group, and a silane compound having substitutes that react with the substrate. And, amino groups, carboxylic groups and so on are mentioned as the substitutes that react with the substrate.

In the above-mentioned composition, cross-linking of a liquid repellent layer means formation of siloxane network through the hydrolysis and condensation.

Generally cross-linked siloxane network affected by the ink that used in the ink jet recording system, especially when it is not a neutral aqueous solution. Siloxane network is rehydrolyzed and liquid repellency decreases. Moreover above-mentioned composition does not refer to the photo-sensitive characteristic.

U.S. Pat. No. 6,283,578, EP B1 816094 are disclosing surface treatment for liquid repellent nature with silane compounds having a photo-radical polymerizable group. In this composition, cross-linking of a liquid repellent layer means formation of siloxane network and photo-radical polymerization. And photo-radical polymerization is corresponding photo-sensitive characteristic. Liquid repellency is derived from siloxane network itself.

Moreover, the above-mentioned specification is referring to the coating of a hydrolyzable silane compound having a fluorine containing group as the 2nd layer on the above-mentioned siloxane structure, when the higher liquid repellency is required.

However, in the above-mentioned two-layer composition, since there is no photo-sensitive characteristic in the hydrolyzable silane compound layer itself that has a fluorine containing group, the photo-sensitive characteristic cannot be given.

Jpn. J. Appl. Phys. Vol. 41 (2002) P. 3896-3901 is disclosing condensation products of specific aryl silane and a hydrolyzable silane compound having a fluorine containing group as a liquid repellent layer which shows excellent durability in alkaline ink. However, in this above-mentioned composition, addition of photo-sensitive characteristic is difficult.

Moreover, this applicant has proposed the method given in Japanese patent Application Laid-Open No. H04-10940 to No. H04-10942 as the high quality IJ recording method.

Furthermore, this applicant has proposed the method given in Japanese patent Application Laid-Open No. H06-286149 as the manufacturing method of the optimal IJ head for the above-mentioned IJ recording method given in Japanese patent Application Laid-Open No. H04-10940 to No. H04-10942.

The above-mentioned method uses photo-sensitive materials for a nozzle portion, and realizes precise nozzle structure with photolithography technology.

The liquid repellent material shown in the above-mentioned conventional example here was difficult to have the photo-sensitive characteristic, and application for the nozzle formation using photolithography technology was difficult.

On the other hand, this applicant has proposed the material of a publication to. Japanese patent Application Laid-Open No. H11-322896, No. H11-335440, No. 2000-322896 as a liquid repellent material that have the photo-sensitive characteristic applicable to the above-mentioned Japanese patent Application Laid-Open No. H06-286149.

Although the above mentioned liquid repellent materials are excellent in respect of photo-sensitive characteristic, high liquid repellency, and adhesion force with the nozzle material etc., higher liquid repellency, durability (to maintain high liquid repellency) against the wiping and the ease of wiping are required, because they need to output a higher-quality image at high speed.

U.S. Pat. No. 5,644,014, EP B1 587667 and Japanese patent publication No. 3306442 are indicating the liquid repellent material using the hydrolyzable silane compound which has a fluorine containing group.

Although the above-mentioned material is indicating the photo curability using photo radical polymerization, it is not mentioned about formation of pattern using photo lithography technology or the application to an ink jet head.

DISCLOSURE OF THE INVENTION

This invention is made in view of the above-mentioned many points, carried out to offer high liquid repellency, high durability against the wiping (to maintain high liquid repellency), the ease of wiping and the high adhesion power to the nozzle material simultaneously, and to provide liquid repellent material of an ink jet head, which realizes high-quality image recording.

Furthermore, this invention is to provide photo-sensitive characteristic to the above-mentioned liquid repellent, and is to offer the manufacturing method of the ink jet head for the high-quality image recording.

The present invention designed to attain the above-mentioned objectives is an ink jet head, wherein the surface of ejection having a liquid repellent characteristic; wherein said ejection opening surface made of condensation product comprising a hydrolyzable silane compound having a fluorine containing group, and a hydrolyzable silane compound having a cationic polymerizable group.

Another present invention designed to attain the above-mentioned objectives is a method of manufacturing an ink jet head comprising;

forming a nozzle surface having liquid repellent characteristic by pattern-exposure and developing simultaneously after forming a photo-polymerizable liquid repellent layer on a photo-polymerizable resin layer, wherein the photo-polymerizable liquid repellent layer contains a condensation product of a hydrolyzable silane compound having a fluorine containing group and a hydrolyzable silane compound having the cationic polymerizable group.

Furthermore, it is preferable as the manufacturing method of the ink jet head comprising;

forming an ink passage pattern with a dissoluble resin material on an ink ejection pressure generating element on a substrate, forming a polymerizable coating resin layer on the dissoluble resin material pattern, forming a liquid repellent layer on the coating resin layer, forming an ink ejection opening by removing the coating resin layer and the liquid repellent layer above ink ejection pressure generating element, dissolving the dissoluble resin material pattern, wherein the liquid repellent layer contains a condensation product of a hydrolyzable silane compound having a fluorine containing group and a hydrolyzable silane compound having a cationic polymerizable group.

BEST MODES FOR CARRYING OUT THE INVENTION

Figure 1A:
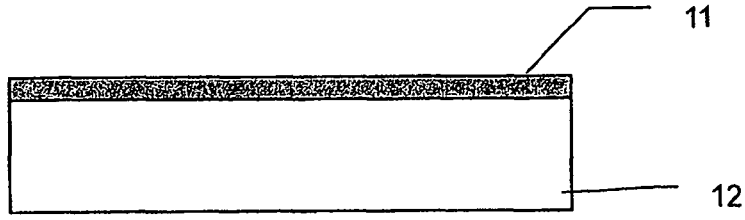
FIGS. 1A, 1B, 1C and 1D are figures showing an example of the manufacturing method of the ink jet head by this invention.

The present invention will be described in detail. Like the above-mentioned, it is well known to use the hydrolyzable silane compound having a fluorine containing group for the liquid repellent layer of an ink jet head.

However, when the hydrolyzable silane compound having a fluorine containing group was made to react to the nozzle surface through hydrolysis reaction and a liquid repellent layer is formed as near a monomolecular layer, the liquid repellent layer exfoliates in wiping operation to clean up the nozzle surface, and the liquid repellent performance of the nozzle surface cannot be maintained. Generally, since a liquid repellent layer always contacts with the recording liquid that is not neutral, liquid repellency deteriorated in response to hydrolysis reaction. Furthermore, it was difficult to give the photo-sensitive characteristic for forming high-precision nozzle structure. These inventors dedicated to find out that the above-mentioned subject was solvable by forming a liquid repellent layer with the condensation product of the hydrolysis silane compound having a fluorine containing group and the hydrolysis compound having a cationic polymerizable group as a result of examination.

According to the composition of the liquid repellent layer of this invention, the cured material has the siloxane frame (Inorganic frame) formed from the hydrolyzable silane, and a frame (Organic frame: ether bond when using the epoxy group) by curing the cationic polymerizable group. Thereby, a cured material becomes into the so-called organic and inorganic hybrid cured material, and durability against wiping and its recording liquid is improved by leaps and bounds. That is, it is thought that its strength as a film improves and its wiping resistance improves compared with liquid repellent layer formed only by the siloxane frame since the liquid repellent layer of this invention has an organic frame.

Moreover, since an organic frame is formed by cationic polymerization (typically ether bond formation), the frame of the liquid repellent layer is hard to be hydrolyzed even if recording liquid is not neutral. And outstanding recording liquid resistance is obtained. When an organic frame is formed by radical polymerization here, many radical polymerizable groups represented by the methacryloxy group, include ester bond which is rather week against hydrolysis, and may not be desirable in respect of recording liquid resistance. In this invention, the liquid repellent layer formed with the organic frame by cationic polymerization and siloxane frame, reduce re-hydrolysis of a siloxane frame also and contributing its surprising improvement of recording liquid resistance.

Moreover, according to this invention, formation of the siloxane frame and the organic frame by cationic polymerization at the time of curing of a liquid repellent layer contributes also to formation of chemical bonds with the nozzle surface and improvement in the adhesion nature to a nozzle surface. Especially, forming the liquid repellent layer on the cationic polymerizable nozzle layer, followed by curing of the liquid repellent layer and the nozzle layer simultaneously, which are desirable especially from a viewpoint of adhesion property. Moreover, in the liquid repellent layer of this invention, including the cationic photo-polymerization initiator within the liquid repellent layer makes it possible to generate the acid by photo irradiation, and to cure the liquid repellent layer by polymerization of a cationic polymerizable group. Although curing of hydrolyzable silane compounds (hydrolysis and condensation reaction) is generally carried out by heat, a hydrolysis reaction is promoted by existence of acid, and a firm frame can be formed. Furthermore, it is possible to provide photosensitivity to a liquid repellent layer in the above embodiment, and it is possible to form precise nozzle structure. Moreover, in the embodiment which forms the liquid repellent layer on the cationic polymerizable nozzle layer, followed by curing the liquid repellent layer and the nozzle layer simultaneously, as a matter of course, it is possible to cure both layers in the case of including a cationic photo-polymerization initiator within both of the liquid repellent layer and the nozzle layer. These inventors found out that a liquid repellent layer could be cured by cationic polymerization also in the surprising embodiment that does not include the cationic photo-polymerization initiator in the liquid repellent layer but only a nozzle layer. This phenomenon is thought that the acid generated from the cationic photo-polymerization initiator in the nozzle layer by photo irradiation can be diffusing into the liquid repellent layer, and the liquid repellent layer can also be cured. As an advantage of the above-mentioned embodiment, since curing of the liquid repellent layer takes place only in the portion that the nozzle layer is cured, the conditions for nozzle patterning do not depend on the liquid repellent layer. That is, it is not necessary to take into consideration the photo-sensitivity difference between the liquid repellent layer and the nozzle layer. Generally, it is difficult to make the photo-sensitive property of two or more photo-sensitive resin layers consistent completely.

Next, the composition material of the liquid repellent layer used for this invention will be described in detail.

As a hydrolyzable silane compound having a fluorine containing group, alkoxysilane which has the fluorinated alkyl group represented by general formula (1) is suitably used.

$$R_f Si(R)_b X_{(3-b)} \quad (1)$$

wherein $R_f$ is a non-hydrolyzable substituent having 1 to 30 fluorine atoms bonded to carbon atoms, R is a non-hydrolyzable substituent, X is a hydrolyzable substituent, and b is an integer from 0 to 2, preferably 0 or 1 and in particular 0.

A particular preferred substituent $R_f$ is $CF_3(CF_2)_n$-Z— where n and Z are defined as defined in general formula (4) below.

$$CF_3(CF_2)_n—Z—SiX_3 \quad (4)$$

wherein X is as defined in general formula (1) and preferably is methoxy or ethoxy, Z is a divalent organic group, and n is an integer from 0 to 20, preferably 3 to 15, more preferably 5 to 10. Preferably, Z contains not more than 10 carbon atoms and Z is more preferably a divalent alkylene or alkyleneoxy group having not more than 6 carbon atoms, such as methylene, ethylene, propylene, butylene, methylenoxy, ethyleneoxy, propylenoxy, and butylenoxy. Most preferred is ethylene.

As examples of compound 4, following compounds are included, but this invention is not limited to these following compounds.

$CF_3—C_2H_4—SiX_3$ $C_2F_5—C_2H_4—SiX_3$ $C_4F_9—C_2H_4—SiX_3$ $C_6F_{13}—C_2H_4—SiX_3$ $C_8F_{17}—C_2H_4—SiX_3$ $C_{10}F_{21}—C_2H_4—SiX_3$

X is a methoxy group or an ethoxy group. In the above-mentioned condensation product is prepared using at least two hydrolyzable silanes having a fluorine-containing group, which silanes have a different number of fluorine atoms contained therein.

For example, it is the case where $C_6F_{13}—C_2H_4—SiX_3$, $C_8F_{17}—C_2H_4—SiX_3$, and $C_{10}F_{21}—C_2H_4—SiX_3$ are used simultaneously. The above-mentioned fluorine containing group have tendency to arrange in the surface of the liquid repellent layer. At this time, since the fluoride concentration on the surface becomes high under existence of the fluoro-alkyl group of different length as compared with the case where all the fluoro-alkyl groups have the same length, these inventors found out that liquid repellency, wiping resistance and recording liquid resistance improved. Although it is not clear about the reason of this phenomenon, it is thought that the fluoro-alkyl groups of different length can exist at higher density of itself, since the fluoro-alkyl groups have the shape of straight line, and take the optimal conformation in the surface for the repulsion force of the high electron density of the fluorine atom.

Subsequently, an example of the silane compound having cationic polymerizable group is shown in the following general formula (2).

$$R_c—Si(R)_b X_{(3-B)} \quad (2)$$

Wherein $R_c$ is a non-hydrolyzable substituent having a cationic polymerizable group, R is a non-hydrolyzable substituent, X is a hydrolyzable substituent, and b is an integer from 0 to 2.

As an cationic polymerizable organic group, a cyclic ether group represented by an epoxy group and an oxetane group, a vinyl ether group etc. can be used. In the viewpoint of availability and reaction controls, an epoxy group is preferable.

More specifically, the following compounds are referred as an example.

glycidoxypropyltrimethoxysilane,
glycidoxypropyltriethoxysilane,
epoxycyclohexylethyltrimethoxysilane,
epoxycyclohexylethyltriethoxysilane etc.

This invention is not limited to the above-mentioned compounds.

In this invention, the liquid repellent layer consists of the cured condensation product including a hydrolyzable silane compound having a fluorine containing group and a hydrolyzable silane compound having the cationic polymerizable group. More preferable, in addition to the hydrolyzable silane compound having a fluorine containing group and the hydrolyzable silane compound having the cationic polymerizable group, the cured condensation product comprises alkyl substituted, aryl substituted or un-substituted hydrolyzable silane compounds. Said alkyl substituted, aryl substituted or un-substituted hydrolyzable silane compounds are useful for controlling the physical properties of the liquid repellent layer.

Examples of said alkyl substituted, aryl substituted or un-substituted hydrolyzable silane compounds are shown in the following general formula (3).

$$R_a—SiX_{(4-a)} \quad (3)$$

$R_a$ is a non-hydrolyzable substituent selected from substituted or unsubstituted alkyls and substituted or unsubstituted aryls, X is a hydrolyzable-substituent, and a is an integer from 0 to 3.

Tetramethoxysilane, tetraethoxysilane, tetrapropoxysilane, methyltrimethoxysilane, methyltriethoxysilane, methyltripropoxysilane, ethyltrimethoxysilane, ethyl triethoxysilane, ethyltripropoxysilane, propyltrimethoxysilane, propyltriethoxysilane, propyltripropoxysilane, phenyltrimethoxysilane, phenyltriethoxysilane, phenyltripropoxysilane, diphenyldimethoxysilane, diphenyldiethoxysilane, dimethyldimethoxysilane, dimethyldiethoxysilane, etc. are specifically mentioned. This invention is not limited to the above-mentioned compound.

The composition of condensation products, that is the combination ratio of constitutes of this above-mentioned invention, hydrolyzable silane compounds having a fluorine containing group, hydrolyzable silane compounds having the cationic polymerizable group, and alkyl substituted, aryl substituted or un-substituted hydrolyzable silane compounds, are suitably decided according to the usage. As for the amounts of addition of the hydrolyzable silane compound having a fluorine containing group, it is desirable that it is 0.5 to 20 mol %, and more preferable 1 to 10 mol %. When the amount of addition is lower, sufficient liquid repellency is not obtained, and when the amount of addition is higher, a homogeneous liquid repellent layer is not obtained. When the uniformity of the surface of the liquid repellent layer is not sufficient, light is scattered at the surface of the liquid repellent layer. That is not desirable especially when the liquid repellent layer has photo-sensitivity.

Moreover, the combination ratio of the hydrolyzable silane compound having the cationic polymerizable group, and the alkyl substituted, aryl substituted or un-substituted hydrolyzable silane compound has the desirable range of 10:1-1:10.

Generally, in the liquid repellent layer of an ink jet head, it is desirable that it has a flat surface with little unevenness. The liquid repellent layer, which has unevenness shows high liquid repellency (high advancing contact angle or high static contact angle) against recording liquid droplets. However when rubbing the liquid repellent layer in wiping operation etc with recording liquid, the recording liquid remains in a concave portion and the liquid repellency of the liquid repellent layer may be spoiled as a result. This phenomenon is remarkable in the embodiment that recording liquid contains pigment, i.e., a color material particle, since the color material particle enters and adheres to the concave portion. Therefore, as for the surface roughness Ra which indicates the unevenness of the liquid repellent layer, it is desirable to be less than 5.0 nm, and it is still more desirable especially that Ra is less than 1.0 nm. In this invention, to form the liquid repellent layer with flat surfaces, it is attained by controlling the amount of the hydrolyzable silane compound having a fluorine containing group and, suitably controlling the amount of the alkyl substituted, aryl substituted or un-substituted hydrolyzable silane compound.

The liquid repellent layer of this invention is formed on a nozzle by curing condensation products of the hydrolyzable silane compound having a fluorine containing group, the hydrolyzable silane compound having the cationic polymerizable group, and if needed, an alkyl substituted, aryl substituted or unsubstituted hydrolyzable silane compound.

Said hydrolyzable condensation product is prepared by carrying out a hydrolysis reaction of the hydrolyzable silane compound having a fluorine containing group, the hydrolyzable silane compound having the cationic polymerizable group, and if needed, an alkyl substituted, aryl substituted or un-substituted hydrolyzable silane compound under existence of water.

The degree of condensation of the product can be controlled suitably by temperature, PH, etc. of the condensation reaction. Moreover, it is also possible to use metal alkoxides as a catalyst of hydrolysis reaction and to control the degree of condensation in consequence of a hydrolysis reaction. It is referred, aluminum alkoxide, titanium alkoxide, zirconium alkoxide, and its complexes (acetyl acetone complex etc.) as metal alkoxide.

Moreover, it is referred onium salt, borate salt, the compound having imide structure, the compound having triazine structure, an azo compound, or a peroxide as a cationic photo-polymerization initiator. It is desirable the aromatic sulfonium salt or aromatic iodonium salt from sensitivity and stability.

Subsequently, it is explained the example of the ink jet head which has the liquid repellent layer of this invention.

FIGS. 1A, 1B, 1C and 1D are the conceptual diagrams showing the manufacturing method of the ink jet head of the present invention.

At first, FIG. 1A is showing that the liquid repellent layer 11 is formed on the nozzle plate 12 of resin or the SUS plate.

Figure 1B:
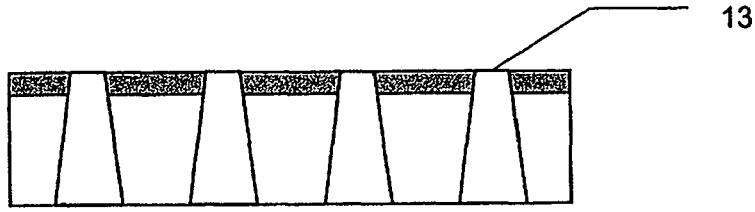
Figure 1C:
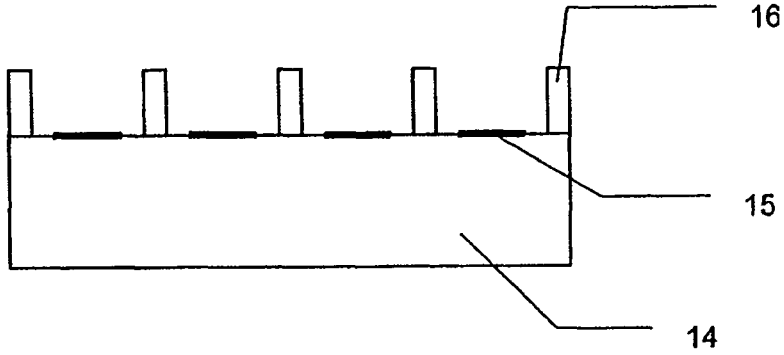
Figure 1D:
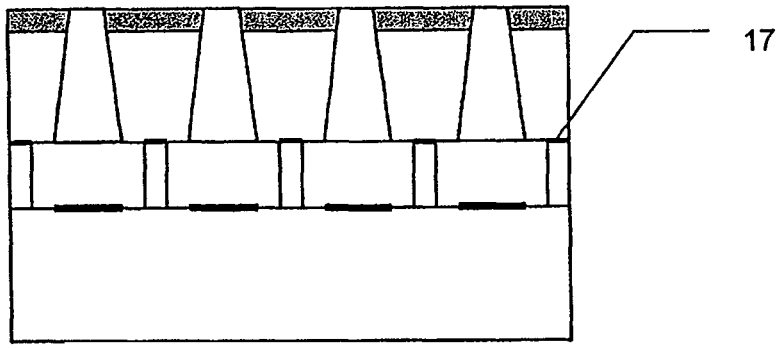

The liquid repellent layer 11 is applied by spray, dipping, or spin coating with the liquid containing condensation product, which is prepared by carrying out a hydrolysis reaction of a hydrolyzable silane compound having a fluorine containing group, a hydrolyzable silane compound having the cationic polymerizable group, and if needed, an alkyl substituted, aryl substituted or un-substituted hydrolyzable silane compound, followed by curing with heat-treatment or photo irradiation. The thickness of the liquid repellent layer 11 is suitably determined by the form of the usage and the range of about 0.1 to 2 micrometer is desirable. Subsequently, an ink ejecting outlet is formed by macining techniques, such as excimer laser processing, pulse laser processing, and electrical discharge processing to the nozzle plate on which the liquid repellent layer was formed. (FIG. 1B)

Not to mention that curing of the liquid repellent layer can be carried out after forming an ink ejecting outlet 13. Furthermore, on the occasion of ink ejecting outlet processing, you may arrange a protection film etc. on the liquid repellent layer suitably.

The above-mentioned technique is a desirable embodiment because that does not generate entering the liquid repellent material within the ink ejecting outlet since the nozzle plate and the liquid repellent layer can be processed by package.

Subsequently, a substrate 14 (FIG. 1C) comprising the ink ejection pressure generating element 15 and passage member 16 are prepared. And an ink jet head is completed by adhering the substrate 14 and the nozzle plate comprising the ink ejection outlet if needed through an adhesive layer.

Moreover, in the case of using the photo-curable material as the nozzle plate in the above-mentioned method, it is also possible to create a nozzle plate as follows.

Figure 2A:
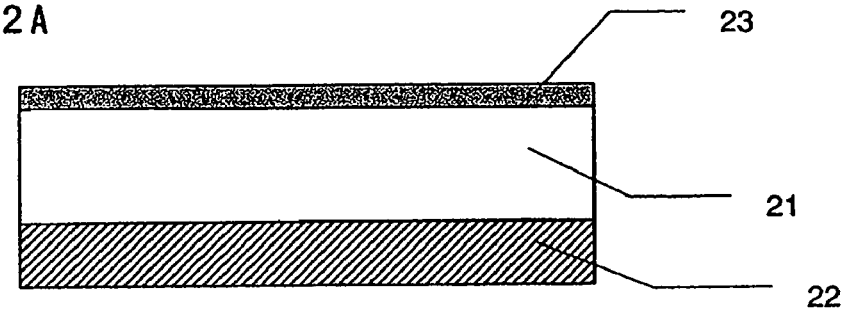
FIGS. 2A, 2B, 2C and 2D are figures showing another example of the manufacturing method of the ink jet head by this invention.
Figure 2B:
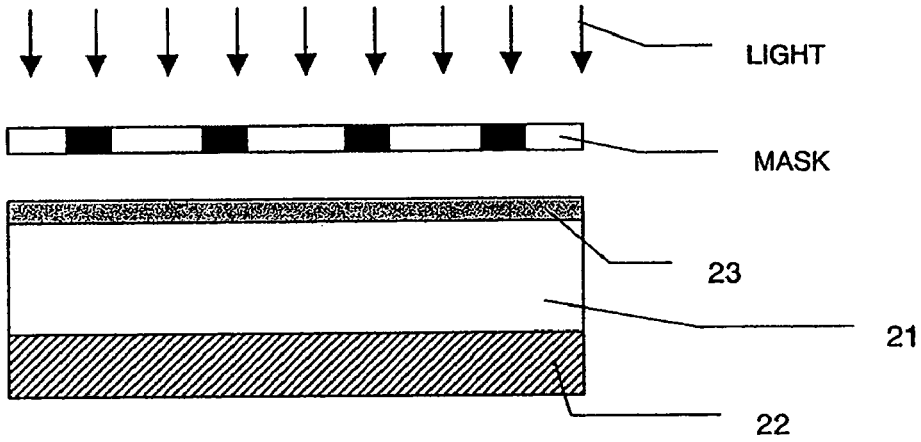
Figure 2C:
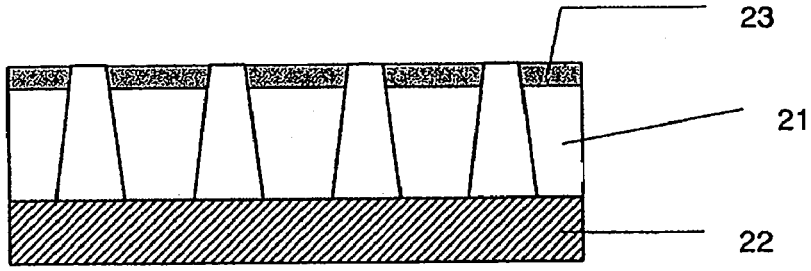
Figure 2D:
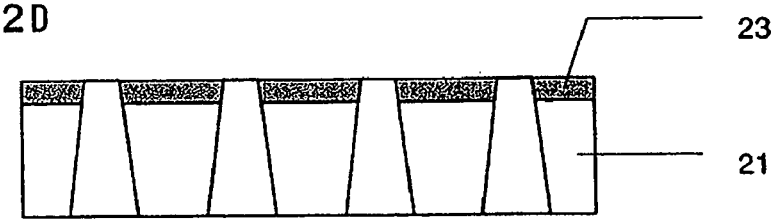

A nozzle material 21 is formed on a base member 22 as shown in FIG. 2A. And a liquid repellent layer 23 is formed on a nozzle material 21 by applying the liquid containing hydrolyzable condensation products, which were prepared by carrying out a hydrolysis reaction of a hydrolyzable silane compound having a fluorine containing group, a hydrolyzable silane compound having the cationic polymerizable group, and if needed an alkyl substituted, aryl substituted or un-substituted hydrolyzable silane compound (FIG. 2B). The nozzle material 21 and the liquid repellent layer 23 are cured using pattern exposure, as shown in FIG. 2C, and a non-cured portion is removed by development processing (FIG. 2D). After forming the nozzle having the liquid repellent layer, it peels from the base member suitably. Subsequently, the substrate comprising the ink ejection pressure-generating element and passage member are prepared. And an ink jet head is completed by adhering the substrate and the nozzle plate comprising the ink ejection outlet if needed through an adhesive layer.

Next, it is explained the embodiment of this invention, which is applied to the above-mentioned method of manufacturing an ink jet head described in Japanese patent Application Laid-Open No. H06-286149.

said method of manufacturing an ink jet head comprising;

forming an ink passage pattern with a dissoluble resin material on the substrate in which an ink ejection pressure generating element was formed, forming a coating resin layer by applying a polymerizable coating resin on the dissoluble resin material layer as an ink passage wall, forming an ink ejection outlet in the coating resin layer and the liquid repellent layer above the ink ejection pressure generating element.

Dissolving the dissoluble resin material layer, wherein the liquid repellent layer contains a cured condensation product of the hydrolyzable silane compound having a fluorine containing group and a hydrolyzable silane compound having the cationic polymerizable group.

It is explained below with a typical conceptual figure.

Figure 3A:
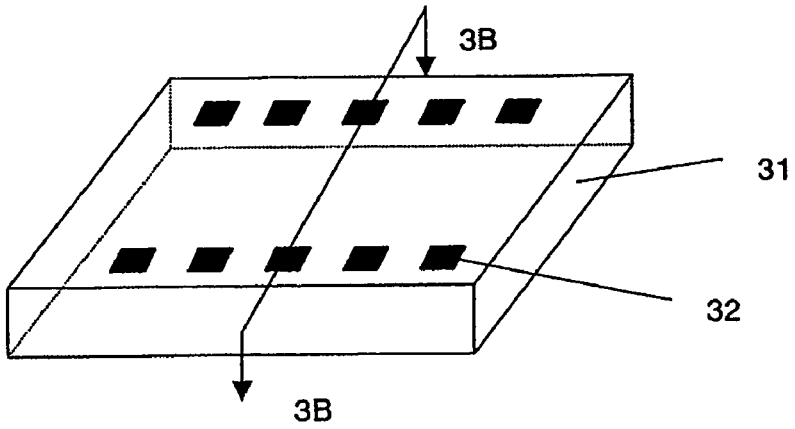
FIGS. 3A, 3B, 3C, 3D, 3E, 3F, 3G, 3H, 3I, 3J and 3K are figures showing furthermore another example of the manufacturing method of the ink jet head by this invention.
Figure 3B:
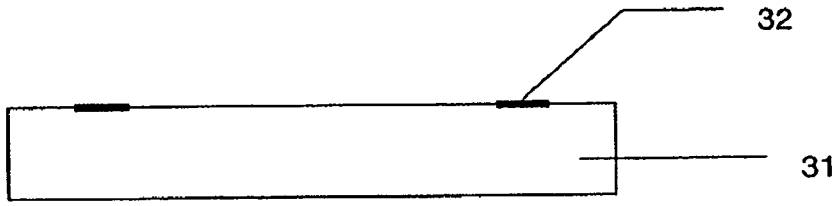
Figure 3C:
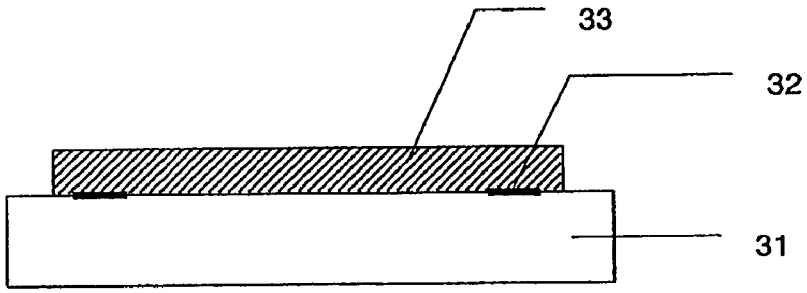

FIG. 3A is a perspective view of the substrate 31 formed the ink ejection pressure-generating element 32. FIG. 3B is a 3B-3B sectional view of FIG. 3A. FIG. 3C is a figure of the substrate formed ink passage pattern 33 with the dissoluble resin material. It is suitably used a positive type resist, especially a photo-decomposable positive type resist with a comparatively high molecular weight, so as to avoid collapse of the ink passage pattern even on which a nozzle material layer is formed in the consequent process.

Figure 3D:
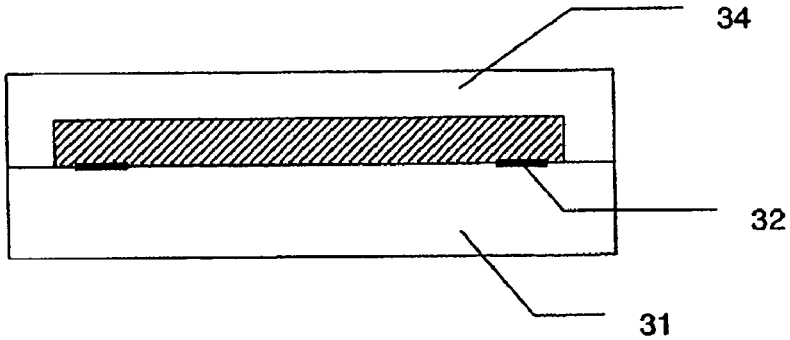

Subsequently, FIG. 3D shows that has the coating resin layer 34 is formed on the ink passage pattern.

Figure 3E:
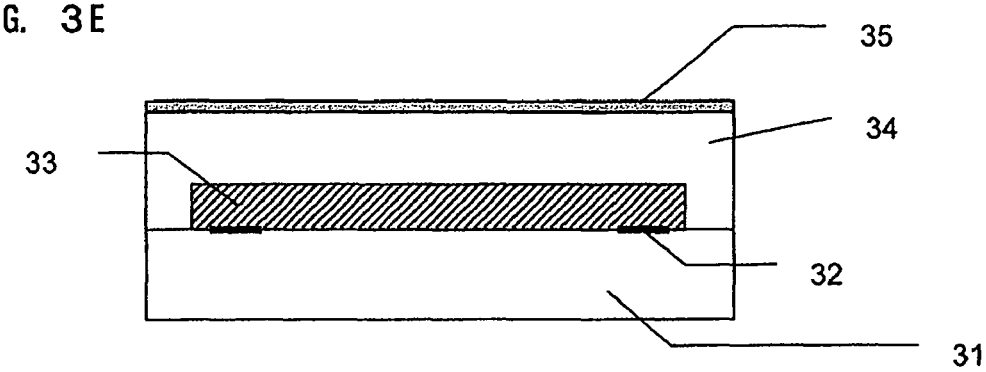

The coating resin layer is the material that is polymerizable by light irradiation or thermal treatment, especially as the coating resin layer, a cationic photo-polymerizable resin is suitable. FIG. 3E shows that the liquid repellent layer 35 is formed on the coating resin layer further.

Figure 3F:
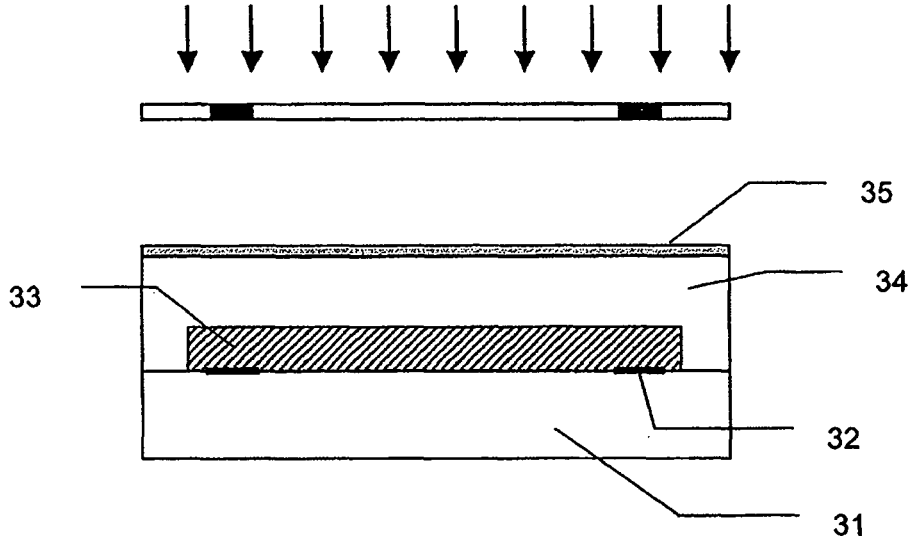
Figure 3G:
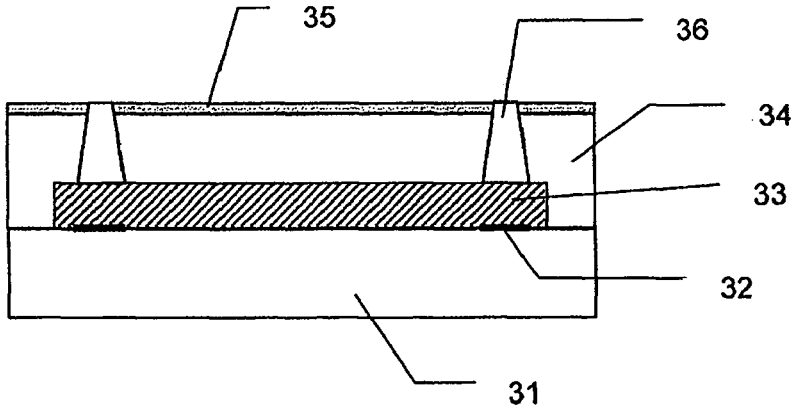
Figure 3H:
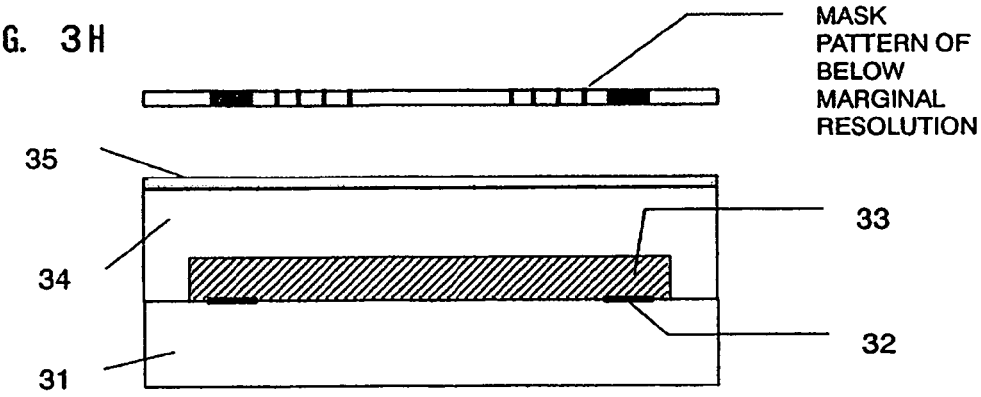
Figure 3I:
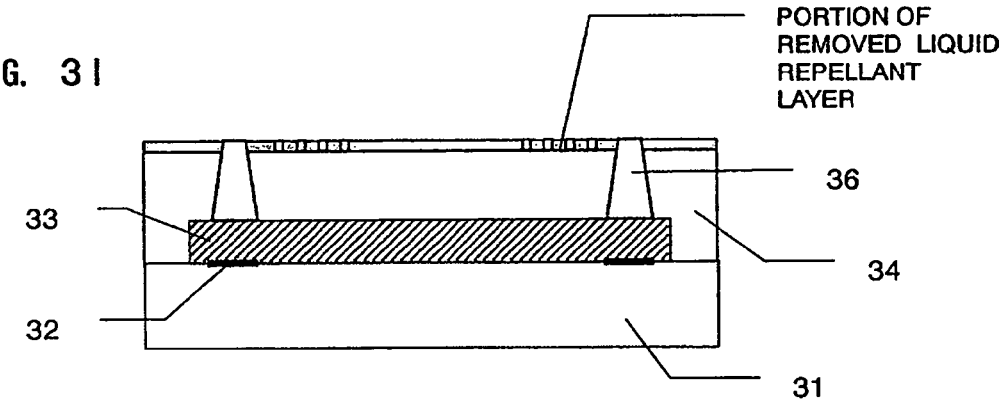

The coating resin layer and the liquid repellent layer can be suitably formed by Spin coating, direct coating, etc. Direct coating is suitably used especially for formation of the liquid repellent layer. Although the coating resin layer includes the cationic initiator as an indispensable ingredient, the liquid repellent layer does not need to include the cationic initiator as the above-mentioned. The liquid repellent layer can be cured by the acid generated at the time of curing of the coating resin layer. Subsequently, an ejection outlet 36 is formed by a pattern exposure through a mask as shown in FIG. 3F and developing as shown in FIG. 3G. Moreover, only the liquid repellent layer can be removed partially except an ejection outlet forming portion by setting up suitably the mask pattern and the exposure conditions. That is, when the mask pattern is below marginal, only the liquid repellent layer is removed partially. The marginal resolution means a pattern size by which the coating resin layer is not developed to substrate. (FIGS. 3H and 3I)

Like the above-mentioned, the liquid repellent layer of this invention has high liquid repellency and wiping resistance. Therefore, when performing wiping operation, the recording liquid droplet which should be removed may roll, and be drawn to an ejection outlet. Consequently it may occur not to eject the recording liquid droplet.

In order to prevent this phenomenon, Japanese patent Application Laid-Open No. H06-210859 has proposed establishing a liquid repellent area and a non-liquid repellent area in the nozzle surface. This invention, like the above-mentioned, can form easily a pattern, which does not exist partially in the liquid repellent layer, and prevent not ejecting ink.

Figure 3J:
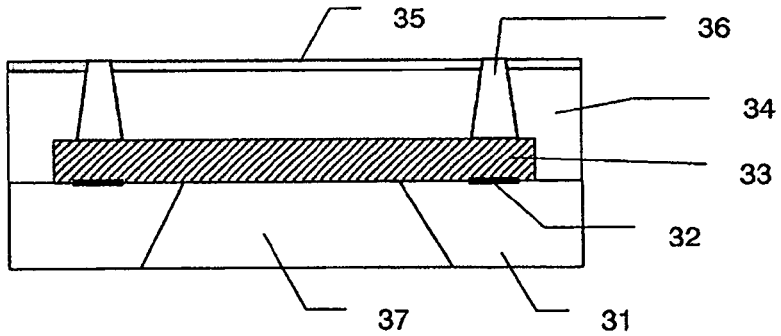
Figure 3K:
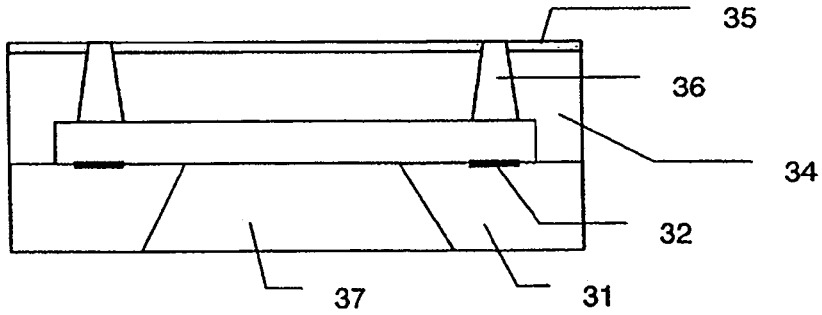

Subsequently, an ink supply opening 37 is suitably formed to a substrate (FIG. 3J), and an ink passage 33 pattern is made to dissolve (FIG. 3K). Finally, if needed, by heat-treatment, the nozzle material and a photo-sensitive liquid repellent material are cured completely, and an ink jet head is completed. It was described the case that it is used the cationic photo-polymerizable material as the coating resin layer in the figure for illustrating.

You may form the ejection outlet by using a thermosetting cationic polymerization material as a coating resin layer, and using an excimer laser instead of pattern exposure after liquid repellent layer formation to remove the coating resin layer and the liquid repellent layer by ablation.

EMBODIMENT

Synthetic Example 1

A hydrolyzable condensation product was prepared according to the following procedures. Glycidylpropyltriethoxysilane 28 g (0.1 mol), methyltriethoxysilane 18 g (0.1 mol), trideca fluoro-1,1,2,2-tetrahydroctyltriethoxysilane 6.6 g (0.013 mol, equivalent for 6 mol % in total amount of the hydrolyzable silane compound), water 17.3 g, and ethanol 37 g was stirred at room temperature, subsequently refluxed for 24 hours, thus a hydrolyzable condensation product was obtained.

Furthermore, the condensation product was diluted with 2-butanol and ethanol to 7 wt % as nonvolatile content, and the composition 1, which forms the liquid repellent layer was obtained.

Furthermore, the composition 1 100 g was added aromaticsulfonium hexafluoroantimonate salt 0.04 g (brand name SP170 Asahi Denka Kogyo K.K. make) as a cationic photo-polymerization initiator, and the composition 2 which forms the liquid repellent layer was obtained.

Synthetic Example 2

A hydrolyzable condensation product was obtained by using 4.4 g of mixtures of tridecafluoro-1,1,2,2-tetrahydroctyltriethoxysilane, and heptadecafluoro-1,1,1,2-tetrahydrodecyltriethoxysilane, instead of tridecafluoro-1,1,2,2-tetrahydroctyltriethoxysilane 6.6 g in the synthetic example 1. Other conditions were all the same.

Furthermore, the condensation product was diluted with 2-butanol and ethanol to 7 wt % as nonvolatile content, and the composition 3, which forms the liquid repellent layer was obtained. Furthermore, the composition 3 100g was added aromaticsulfonium hexafluoroantimonate salt 0.04 g (brand name SP170 Asahi Denka Kogyo K.K. make) as a cationic photo-polymerization initiator, and the composition 4 which forms the liquid repellent layer was obtained.

Embodiment 1

The above-mentioned compositions 2 and 4 were applied by the roll coating method on the polyamide film, the application solvent was dried at 90 degrees C. and heating for 1 minute, thus the application film was formed.

Subsequently, compositions 2 and 4 were cured by exposing by using UV irradiation equipment and heating at 90 degrees C. for 4 minutes. Furthermore, by heating at 200 degrees C. for 1 hour in a heating oven, the curing reaction was terminated and the liquid repellent layer was formed. Subsequently, the contact angle against the ink jet ink was measured as evaluation of liquid repellency using an automatic contact angle meter (Kyowa Interface Science, CA-W). Henceforth, θ a means a receding contact angle and θr means an advancing contact angle. According to examination of these inventors, the contact angle against ink, especially a receding contact angle, which has strong influence on ink removal from the nozzle surface by wiping, is desirable to be higher. Results are shown in Table 1.

TABLE 1

| recording liquid | Ink BCI-3Bk θa | Ink BCI-3Bk θr | Ink BCI-8Bk θa | Ink BCI-8Bk θr |
|---|---|---|---|---|
| liquid repellent layer 2 | 85° | 75° | 90° | 78° |
| liquid repellent layer 4 | 89° | 80° | 95° | 83° |

Here, BCI-3Bk that is commercially available from CANON, is a neutral pigment ink with a surface tension about 40 mN/m. And BCI-8Bk that is also commercially available from CANON, is an alkaline dye ink with a surface tension about 42 mN/m.

Subsequently, the ink resistance of the liquid repellent layer was examined by immersing the polyamide film on which said liquid repellent layer was formed in ink BCI-3Bk and 8Bk for four weeks at the temperature of 60 degrees C.

Results are shown in Table 2 or 3.

TABLE 2

| (Result in ink BCI-3Bk) | | | | |
|---|---|---|---|---|
| recording liquid | First stage | | After immersion for four weeks | |
| Ink BCI-3Bk | θa | θr | θa | θr |
| liquid repellent layer 2 | 85° | 75° | 71° | 61° |
| liquid repellent layer 4 | 89° | 80° | 83° | 69° |

TABLE 3

| (Result in ink BCI-8Bk) | | | | |
|---|---|---|---|---|
| recording liquid | First stage | | After immersion for four weeks | |
| Ink BCI-8Bk | θa | θr | θa | θr |
| liquid repellent layer 2 | 90° | 78° | 72° | 56° |
| liquid repellent layer 4 | 95° | 83° | 84° | 67° |

The liquid repellent layer by this invention showed a very high contact angle against inks, i.e., high liquid repellency from the above-mentioned result.

Further maintaining sufficient liquid repellency also after immersing test assuming long-term preservation.

Further improving liquid repellency especially the resistance against alkaline ink even in the case where the hydrolyzable condensation product consists of two or more hydrolyzable silane compounds having a fluorinated alkyl group of different length.

The ink ejection outlet was formed by irradiating the excimer laser in the polyamide film having the liquid repellent layer on the surface according to above-mentioned method. Subsequently, as shown in FIGS. 1A, 1B, 1C and 1D, the film was integrated on the substrate having the ink ejection pressure generating element and the ink passage wall, thus the ink jet head was obtained. Printing quality of the above-mentioned ink jet head was highly defined.

Embodiment 2

In this embodiment, the ink jet head was produced according to the procedure shown in the above-mentioned FIGS. 3A, 3B, 3C, 3D, 3E, 3F and 3G.

First, the silicone substrate having the electric heat conversion element as an ink ejection pressure generating element was prepared and the application film, polymethyl isopropenyl ketone (ODUR-1010, Tokyo Oka Kogyo Kabushiki Kaisha). was applied by spin coating as a dissoluble resin material layer on this silicone substrate. Subsequently, after prebaking at 120 degrees C. for 6 minutes, pattern exposure of ink passage was performed by mask aligner UX3000 (USHIO Electrical machinery).

Exposure time was for 3 minutes, and development was carried out with methyl isobutyl ketone/xylene=2/1, and rinsed with xylene.

Said polymethyl isopropeny ketone is the so-called positive type resist, which decomposes and becomes soluble to the organic solvent by UV irradiation. The pattern of the dissoluble resin material was formed in the portion which was not exposed in the case of pattern exposure, and the ink supply passage pattern was obtained (FIG. 3C). The thickness of the dissoluble resin material layer after development was 20 micrometers. Subsequently, coating resin consisted of the cationic photo-polymerization shown in Table 4 was dissolved in methyl isobutyl ketone/xylene mixture solvent at 55 wt % concentration, and it applied by spin coating on the ink passage pattern formed by said dissoluble resin material layer, and baked at 90 degrees C. for 4-minute. The thickness of the coating resin layer on the ink passage pattern was 55 micrometers by repeating this application and baking 3 times (FIG. 3D).

TABLE 4

| | | |
|---|---|---|
| Epoxy resin | EHPE-3150, Daicel Chemical | 100 parts |
| Additive | 1,4-HFAB, Central Glass | 20 parts |
| Cationic photo-polymerization initiator | SP172, Asahi Denka Kogyo | 5 parts |
| Silane coupling agent | A187, Nippon Unicer | 5 parts |

1,4-HFAB: (1,4-bis (2-hydroxyhexafluoroisopropyl) benzene)

Subsequently, the composition 1, which consists of the hydrolyzable condensation product of said fluorine containing silane compound, applied on the coating resin layer by direct coating. Subsequently, pre-baking was performed at 90 degrees C. for 1 minute, and thickness of the layer was 0.5 micrometer. Here, a cationic photo-polymerization initiator is not included in a composition 1. Subsequently, pattern exposure of the ink ejection outlet was performed using mask aligner MPA600 super (CANON). (FIG. 3F)

The ejection outlet pattern was formed by heating at 90 degrees C. for 4 minutes, followed by developing with methyl isobutyl ketone (MIBK)/xylene=⅔ and rinsed with isopropyl alcohol. Here, the layer of the composition 1 was cured except the ejection outlet by the cationic photo-polymerization initiator in the coating resin layer, while the ejection outlet pattern was obtained by curing the coating resin layer. And the pattern edge of the pattern was sharp (FIG. 3G). Subsequently, the mask for forming an ink supply opening in the back side of the substrate was arranged suitably, and the ink supply opening was formed by anisotropic etching of a Silicone substrate. The surface of the substrate formed the nozzle was protected by a rubber film during the anisotropic etching of silicone. The rubber film was removed after completion of anisotropic etching, and the dissoluble resin material layer forming ink passage pattern was decomposed by irradiating UV light on the whole surface using said UX3000 again. Subsequently, the ink passage pattern was dissolved by immersing into methyl lactate for 1 hour using an ultrasonic wave. Subsequently, in order to cure the coating resin layer and the liquid repellent layer completely, heating process was performed at 200 degrees C. for 1 hour (FIG. 3K). Finally, an ink jet head was completed by adhering the ink supply member on the ink supply opening. The ink jet head obtained by the above-mentioned method was filled up with ink BCI-3Bk made by CANON, printed out images, and a high-quality image was obtained. Moreover, the advancing contact angle against the ink BCI-3Bk for the ink jet head showed 86 degrees, and 65 degrees for receding contact angle, and said liquid repellent layer proved to have high liquid repellency. Subsequently, the surface roughness of liquid repellent layer of said ink jet head was measured by scanning probe model microscope JSPM-4210 in contact mode. As a result, the surface roughness index Ra was 0.2 to 0.3 nm (Scanning area was 10-micrometer square), and liquid repellent layer proved to form very flat and smooth surfaces. Subsequently, wiping operation was performed 30000 times with the blade of HNBR rubber while spraying ink on the nozzle surface of this ink jet head. After the wiping operation, the same high quality image as before the wiping could be obtained, and thus, excellent wiping durability was confirmed. Furthermore, the above-mentioned composition 3 was used as a liquid repellent layer replaced with the above-mentioned composition 1, and the ink jet head was completed in the same way. Even after the above-mentioned wiping operation was applied, the quality of printing image did not changed as before, and excellent wiping durability was confirmed.

According to the above-mentioned result, the liquid repellent layer of this invention is able to form a refined ejection outlet structure by applying on the cationic photo-polymerizable nozzle material followed by simultaneous pattern-exposure of the nozzle material and the liquid repellent layer and shows high liquid repellency. Because of the excellent wiping durability, high quality images can be obtained even after wiping.

The invention claimed is:

1. An ink jet head with a member including an ejection opening, wherein said member is formed of a cured product of a resin having an epoxy group, a surface of said member is formed of a condensation product made from a hydrolyzable silane compound having a fluorine-containing group, and a hydrolyzable silane compound having an epoxy group or an oxetane group, and said surface of said member is formed by a bonding reaction of said resin and said condensation product.

2. An ink jet head according to claim 1, wherein said condensation product is further made from a hydrolyzable silane compound having an alkyl substituent, a hydrolyzable silane compound having an aryl substituent, or a hydrolyzable silane compound having no non-hydrolyzable substituent.

3. An ink jet head according to claim 1 or 2, wherein said hydrolyzable silane compound having a fluorine-containing group is represented by a general formula (1):

$$R_f—Si(R)_bX_{(3-b)} \quad (1)$$

where $R_f$ is a non-hydrolyzable substituent having 1 to 30 fluorine atoms bonded to a carbon atom, R is a non-hydrolyzable substituent, X is a hydrolyzable substituent, and b is an integer from 0 to 2.

4. An ink jet head according to claim 3, wherein the non-hydrolyzable substituent $R_f$ has at least 5 fluorine atoms bonded to a carbon atom.

5. An ink jet head according to claim 4, wherein said condensation product is made from at least two hydrolyzable silanes having a fluorine-containing group containing a different number of fluorine atoms in the fluorine-containing group.

6. An ink jet head according to claim 5, wherein said hydrolyzable silane compound having an epoxy group or an oxetane group is represented by a general formula (2):

$$R_c—Si(R)_bX_{(3-b)} \quad (2)$$

where $R_c$ is a non-hydrolyzable substituent having a cationic polymerizable group, R is a non-hydrolyzable substituent, X is a hydrolyzable substituent, and b is an integer from 0 to 2.

7. An ink jet head according to claim 2, wherein said hydrolyzable silane compound having an alkyl substituent, an aryl substituent or no non-hydrolyzable substituent is represented by a general formula (3):

$$R_a—SiX_{(4-a)} \quad (3)$$

where $R_a$ is a non-hydrolyzable substituent selected from substituted or unsubstituted alkyl groups and substituted or unsubstituted aryl groups, X is a hydrolyzable substituent, and a is an integer from 0 to 3.

8. An ink jet head according to any one of claim 1, 2 or 7, wherein said condensation product further contains a cationic initiator.

9. An ink jet head according to claim 8, wherein said cationic initiator causes polymerization by light irradiation.

10. An ink jet head according to claim 9, wherein said surface is an ejection opening surface.

11. An ink jet head according to claim 10, wherein said surface shows a surface roughness Ra of 5.0 nm.

12. An ink jet head according to claim 11, wherein said hydrolyzable silane compound having a fluorine-containing group is used at a molar ratio of 0.5 to 20 mol %, based on the total amount of used hydrolyzable compounds.

13. An ink jet head according to claim 10, wherein a cured liquid repellent material layer formed of the condensation product constitutes said ejection opening surface.

14. An ink jet head according to claim 1, wherein said hydrolyzable silane compound having a fluorine-containing group has the fluorine-containing group and three hydrolyzable substituents.

15. An ink jet head according to claim 1, wherein said hydrolyzable silane compound having a fluorine-containing group is selected from compounds represented by the general formula (4)

$$CF_3(CF_2)_n—Z—SiX_3 \quad (4)$$

wherein X is a hydrolyzable substituent, Z is a divalent organic group, n is an integer from 0 to 20, and Z contains not more than 10 carbon atoms.

16. An ink jet head with a member including an ejection opening, wherein said member is formed of a cured product of a resin having an epoxy group, a surface of said member is formed of a condensation product made from a hydrolyzable silane compound having a fluorine-containing group, and a hydrolyzable silane compound having an epoxy group or an oxetane group and not having a fluorine-containing group, and said surface of said member is formed by a bonding reaction of said resin and said condensation product.

17. An ink jet head with a member including an ejection opening, wherein a surface of said member comprises a polymerization product obtained from a composition comprising a condensation product made from a hydrolyzable silane compound having a fluorine-containing group, and a hydrolyzable silane compound having an epoxy group or an oxetane group and not having a fluorine-containing group, and said epoxy group or oxetane group of said condensation product is used in a polymerization reaction for obtaining said polymerization product.

* * * * *